US012285128B2

(12) United States Patent
Hill

(10) Patent No.: US 12,285,128 B2
(45) Date of Patent: Apr. 29, 2025

(54) SLEEPING BAG WITH INTEGRATED QUILT

(71) Applicant: Bright Path Enterprises LLC, Layton, UT (US)

(72) Inventor: Aaron Hill, Layton, UT (US)

( * ) Notice: Subject to any disclaimer, the term of this patent is extended or adjusted under 35 U.S.C. 154(b) by 0 days.

(21) Appl. No.: 16/357,000

(22) Filed: Mar. 18, 2019

(65) Prior Publication Data

US 2019/0290032 A1 Sep. 26, 2019

Related U.S. Application Data

(60) Provisional application No. 62/645,331, filed on Mar. 20, 2018.

(51) Int. Cl.
*A47G 9/08* (2006.01)
*A47G 9/02* (2006.01)
*A47G 9/04* (2006.01)

(52) U.S. Cl.
CPC ..... *A47G 9/086* (2013.01); *A47G 9/0223* (2013.01); *A47G 9/04* (2013.01)

(58) Field of Classification Search
CPC ..... A47G 9/086; A47G 9/04; A47G 9/0223; A47G 9/0207; A47G 9/08; A47G 9/083
See application file for complete search history.

(56) References Cited

U.S. PATENT DOCUMENTS 2,064,458 A * 12/1936 Bulpit ..... A47G 9/0207 5/413 R
2,379,416 A * 7/1945 Clark ..... A47G 9/086 5/413 R
2,888,009 A 5/1959 Taylor
2,918,683 A * 12/1959 Kaplan ..... A47G 9/086 5/413 R (Continued)

FOREIGN PATENT DOCUMENTS

EP 0095551 A2 12/1983
EP 0095551 A3 12/1983

(Continued)

OTHER PUBLICATIONS

International Search Report and Written Opinion from PCT/US2019/022837, dated Jun. 3, 2019.

(Continued)

*Primary Examiner* — Justin C Mikowski
*Assistant Examiner* — Alison N Labarge
(74) *Attorney, Agent, or Firm* — Maschoff Brennan

(57) ABSTRACT

The sleeping bag assembly may include a sleeping bag, one or more connecting portions, and a quilt. Advantageously, the quilt may be configured to drape over the top of the sleeping bag and cover the less insulated areas of the sleeping bag. The quilt may be configured to be coupled to the sleeping bag via the one or more connecting portions and the connecting portions may keep the quilt on top of the sleeping bag during use. The quilt may also be sized and configured to form a seal about a portion of the sleeping bag, which may increase heat retention and efficiency of the sleeping bag by covering the areas of the sleeping bag that are more susceptible to heat loss, including but not limited to areas that may lack insulation, where the insulation is compressed, and/or where the insulation is separated.

20 Claims, 12 Drawing Sheets

(56) References Cited

U.S. PATENT DOCUMENTS

| | | | | | |
|---|---|---|---|---|---|
| 3,178,734 | A * | 4/1965 | Carrez | A47G 9/08 | 5/413 R |
| 3,988,791 | A * | 11/1976 | Simon | A47G 9/086 | 5/413 R |
| 4,033,001 | A | 7/1977 | Kern | | |
| 4,513,461 | A * | 4/1985 | Tardivel | A47G 9/086 | 2/69.5 |
| 4,884,303 | A * | 12/1989 | Scherer | A47G 9/086 | 5/413 R |
| 5,193,235 | A * | 3/1993 | Kircher | A47G 9/086 | 5/413 R |
| 5,490,294 | A * | 2/1996 | Kramer | A47G 9/086 | 2/69.5 |
| 5,533,216 | A * | 7/1996 | Thier | A47G 9/086 | 5/413 R |
| 5,706,532 | A * | 1/1998 | Kettenhofen | A47G 9/086 | 40/299.01 |
| 6,216,290 | B1 * | 4/2001 | Zemitis | A47G 9/086 | 112/475.08 |
| 7,051,387 | B1 * | 5/2006 | Yoder | A47G 9/086 | 5/413 R |
| 7,774,875 | B1 * | 8/2010 | Zeidman | A01M 1/24 | 5/494 |
| 2003/0226205 | A1 * | 12/2003 | Fishman | A47G 9/086 | 5/413 R |
| 2005/0028277 | A1 | 2/2005 | Gordon | | |
| 2006/0137093 | A1 * | 6/2006 | Dinan | A47G 9/086 | 5/413 R |
| 2008/0256705 | A1 * | 10/2008 | Maguire | A47G 9/086 | 5/413 R |
| 2011/0173749 | A1 | 7/2011 | Martray | | |
| 2012/0180213 | A1 | 7/2012 | Storms | | |
| 2012/0324647 | A1 | 12/2012 | Mckee | | |
| 2014/0345051 | A1 * | 11/2014 | Benninger | A47G 9/086 | 5/413 R |
| 2015/0143635 | A1 * | 5/2015 | Clark | A47G 9/06 | 5/636 |
| 2017/0318990 | A1 * | 11/2017 | David | A47G 9/0261 | |
| 2018/0168373 | A1 * | 6/2018 | Szekeresh | A47G 9/086 | |
| 2019/0183252 | A1 * | 6/2019 | Liu | A47G 9/0261 | |

FOREIGN PATENT DOCUMENTS

| | | | |
|---|---|---|---|
| GB | 2453156 | A | 4/2009 |
| WO | WO 85/04316 | A1 | 10/1985 |

OTHER PUBLICATIONS

International Search Report and Written Opinion from PCT/US2019/017089, dated Apr. 8, 2019.

International Search Report and Written Opinion mailed PCT/US2019/022837, in related PCT Application No. Oct. 1, 2020.

Extended European Search Report mailed Oct. 7, 2021, in related European Application No. 19771023.9.

* cited by examiner

SLEEPING BAG WITH INTEGRATED QUILT

CROSS-REFERENCE TO RELATED APPLICATION

This application claims priority to and the benefit of U.S. Provisional Patent Application Ser. No. 62/645,331 entitled SLEEPING BAG WITH INTEGRATED QUILT, which was filed on Mar. 20, 2018, which is hereby incorporated by reference in its entirety.

BACKGROUND

Field

The present disclosure generally relates to sleeping bags.

Background

People generally use sleeping bags when sleeping outdoors in various climates and at various times of the year. Some people use a light sleeping bag for mild weather and a heavier sleeping bag for colder weather.

BRIEF SUMMARY

Known sleeping bags may have a number of drawbacks or disadvantages. For example, some people use one sleeping bag and then add blankets for colder weather. A problem with blankets is they often slide off a sleeping bag during the night, leaving a user exposed to the cold. It may be difficult to find a blanket that is the correct shape and size to sufficiently cover the sleeping bag during use. It may also be difficult to find a blanket with ideal thermal properties that has been specifically designed for use in the outdoors.

Problems common with heavier, cold-weather sleeping bags may include: (1) there are cold areas around the edges of the sleeping bag, specifically along the hem at the foot of the sleeping bag and zippers that run down the side, and these cold areas may exist partly due to a lack of insulation, compression of the insulation, or separation of the insulation; (2) insulation is not efficiently used because manufactures tend to add insulation equally to the bottom layer and the top layer of the sleeping bag, and the insulation in the bottom layer may become compressed by the weight of a user's body, which may cause the insulation to be less effectual; and 3) additional insulation in the top layer and bottom layer of the sleeping bag may cause the sleeping bags to become heavy and bulky. The heavy and bulky nature of the sleeping bags may make transport difficult and inconvenient. In addition, the added weight may be significant, especially when hiking substantial distances, climbing, mountaineering, and the like.

There are some sleeping bags that include an optional insert that may be inserted inside the sleeping bag for added insulation or warmth. A problem with using the inserts is that the inserts often bunch up or slide to an undesirable location inside the sleeping bag. Also, the inserts are commonly made from materials such as fleece that are not as soft or comfortable to the touch as are the liners found in many sleeping bags. Furthermore, many inserts are not heavily insulated and provide little additional warmth or comfort.

A need therefore exists for a sleeping bag with an integrated quilt that eliminates or diminishes the above-described disadvantages and problems.

A sleeping bag with an integrated quilt may provide a warm and comfortable sleeping bag. For example, the sleeping bag with an integrated quilt may cover the less insulated areas of the sleeping bag with the integrated quilt. To do this effectively, the integrated quilt may be large enough to cover areas on the sleeping bag with less insulation such as the bottom hem and/or zipper. The sleeping bag with an integrated quilt may include a quilt that is securely attached to the sleeping bag. To do this effectively, the integrated quilt may need to be secured to the sleeping bag at various locations such that a user may comfortably move, change position, and/or sprawl without causing the integrated quilt to slide off of the sleeping bag and without the user being overly constricted. The sleeping bag with an integrated quilt may increase the efficiency of the sleeping bag. To do this effectively, the integrated quilt may need to be large enough to create at least a portion of a seal around one or more sides or other portions of the sleeping bag. The efficiency of the sleeping bag may also be increased by varying the direction of the seams and/or insulation chambers running through the integrated quilt with the direction of the seams and/or insulation chambers running through the sleeping bag. For example, the seams and/or insulation chambers of the quilt may be disposed at an angle relative to the seams and/or insulation chambers of the sleeping bag. In an exemplary embodiment, the seams and/or insulation chambers of the quilt and the seams and/or insulation chambers of the sleeping bag may be disposed at a right angle or perpendicular. The seams and/or insulation chambers of the quilt and the seams and/or insulation chambers of the sleeping bag may be disposed at other angles such as about 30 degrees, about 45 degrees, about, 60 degrees, or about 75 degrees. After reviewing this disclosure, one skilled in the art will appreciate that the seams and/or insulation chambers of the quilt and the seams and/or insulation chambers of the sleeping bag may be disposed at other suitable angles, offset, and the like.

The sleeping bag with an integrated quilt may include one or more attachment points or portions such as buckles, buttons, clips, hooks, loops, snaps, ties, toggles, etc. The attachment points may be disposed on an outer portion of the sleeping bag, such as the outside edges of the sleeping bag. A quilt or blanket may be sized and configured to be attached to the sleeping bag. For example, the quilt may include one or more corresponding mating attachment points such as buckles, buttons, clips, hooks, loops, snaps, ties, toggles, etc. The quilt may be secured in place by the attachment points, so it may stay in place while in use. The quilt may be specifically sized so that it may drape over and seal the edges of the sleeping bag. The quilt may increase the efficiency of the sleeping bag the quilt may cover the areas of the sleeping bag that may lack insulation, where the insulation may be compressed, where the insulation may be separated, where seams or zippers occur, etc. Advantageously, the sleeping bag with the integrated quilt may allow the quilt to be attached or removed as desired. For example, if the sleeping bag is being used in a warmer environment, the quilt may not be need. Thus, the quilt may not be attached or the quilt may be removed. On the other hand, in colder environments, the quilt may be needed and the quilt may be attached. Beneficially, the quilt may be quickly and easily connected and/or disconnected from the sleeping bag, which may facilitate use of the sleeping bag. This may also allow a user to disconnect the quilt if they become too warm during use or connect the quilt if they are too cold. Thus, the sleeping bag with the integrated quilt may considerably expand the users of the sleeping bag.

A sleeping bag with an integrated quilt may be more versatile because it can be used in a number of locations and situations. In mild weather the sleeping bag may be used without the quilt. When a warmer sleeping bag is needed, a user may simply attach the integrated quilt to the sleeping bag.

These and other aspects, features and advantages of the present invention will become more fully apparent from the following brief description of the drawings, the drawings, the detailed description of preferred embodiments, and appended claims.

DETAILED DESCRIPTION OF THE FIGURES

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE EXEMPLARY EMBODIMENTS

Figure 1A:
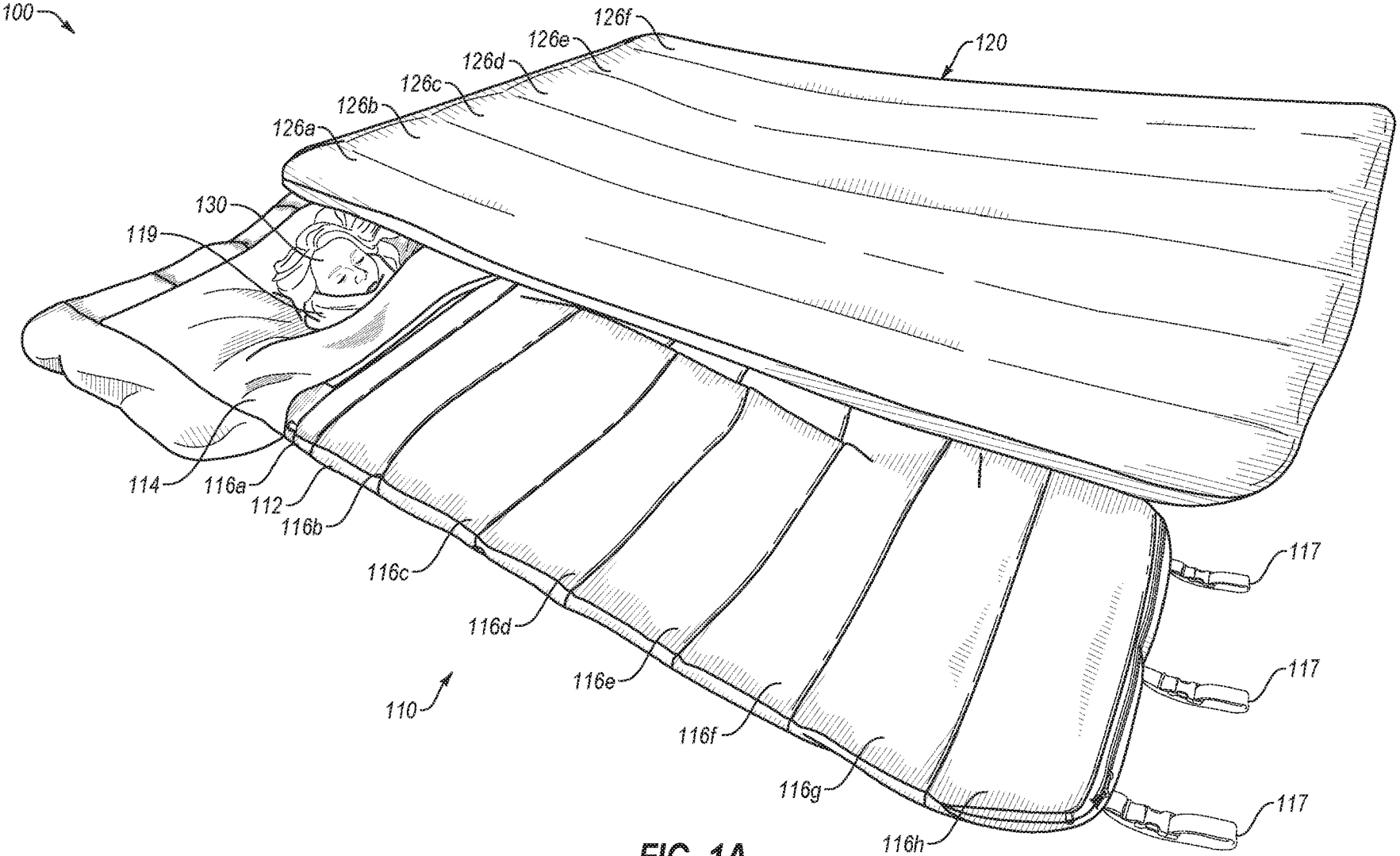
FIG. 1A is an upper perspective view of an exemplary embodiment of a sleeping bag assembly with a sleeping bag and a quilt, and illustrating a user resting inside of the sleeping bag and the quilt spaced apart from the sleeping bag.

The following exemplary embodiments are generally described in connection with sleeping bags with an integrated quilt. The principles of the present invention, however, are not limited to sleeping bags with an integrated quilt. In particular, the principles of the sleeping bags with an integrated quilt may be implemented in connection with other articles. In addition, it will be understood that, with the benefit of the present disclosure, the sleeping bags with an integrated quilt may have a variety of shapes, sizes, configurations, and arrangements. Moreover, while the sleeping bags with an integrated quilt shown in the accompanying figures may be shown in a particular configuration, it will be appreciated the sleeping bags with an integrated quilt may have other suitable styles, arrangements, and configurations. Further, the sleeping bags with an integrated quilt disclosed herein and components thereof may be successfully used in connection with other types of articles and structures.

To assist in the description of exemplary embodiments of the sleeping bags with an integrated quilt, words such as top, bottom, front, rear, right, left, etc. may be used to describe the accompanying figures which may be, but are not necessarily, drawn to scale. It will further be appreciated the sleeping bags with an integrated quilt may be disposed in a variety of desired positions or orientations, and used in numerous locations, environments and arrangements.

The description of exemplary embodiments of the sleeping bags with an integrated quilt may be clarified by the following wording. While the wording may clarify exemplary embodiments of the sleeping bags with an integrated quilt, one skilled in the art will understand the wording may have other meanings after reviewing this disclosure.

A sleeping bag may have a shape or configuration such as an elongated tube. The sleeping bag may be closed on the foot and sides. The sleeping bag may be closed at the foot and on the sides by a zipper or other type of fastener. The sleeping bag may be portable bedding and may be used when sleeping outdoors. A primary purpose of the sleeping bag may be to provide warmth and thermal insulation. A secondary purpose of the sleeping bag may be to provide padding and comfort from the ground. The sleeping bag may include other features and aspects, such as a body portion and/or a top flap.

A sleep chamber may be the area within the body portion and the top flap of the sleeping bag wherein a user normally sleeps.

A shell of the sleeping bag may be the outer layer of fabric that is normally in contact with the open air and ground. The shell could be made with polyester, nylon, cotton, or the like. The inner fabric of the shell may promote heat retention and/or efficiency of the sleeping bag.

A liner of the sleeping bag may be the inner fabric that is normally in contact with a user inside the bag. The liner is often made with fabric that is soft and comfortable to the touch such as flannel or a synthetic. The inner fabric of the liner may be oriented in such a way that may promote the heat retention and/or efficiency of the sleeping bag.

The fill of the sleeping bag may be insulation and the insulation may be disposed between the liner and the shell. The fill may be natural (e.g., goose down) or man-made (e.g., polyester fiberfill). The fill may be oriented to promote heat retention and/or efficiency of the sleeping bag.

The top flap of the sleeping bag may be a panel of fabric that may be used to drape from the shoulders of a user and may extend beyond the top of the head of the user. The top flap may consist of an outer shell, fill, and/or liner. The outer shell, fill, and/or liner of the top flap may be oriented to promote heat retention and/or efficiency of the sleeping bag.

The quilt may be sized, shaped, configured, and/or arranged to be connected to the sleeping bag. The quilt may contain one or more seams and the seams may run across all or part of the width of the sleeping bag. The one or more seams may be used to couple the outer shell, fill, and/or liner of the sleeping bag, which may create one or more compartments or insulation chambers within the sleeping bag.

The sleeping bag may include one or more insulation chambers. The fill may be disposed in the sleeping bag insulation chambers and the fill may be used for padding and/or insulation purposes. The sleeping bag insulation chambers may be separated by seams, fabric, etc. The sleeping bag insulation chambers may run from a first side of the sleeping bag across the width of the sleeping bag to a second side of the sleeping bag, in a generally horizontal direction. The sleeping bag insulation chambers may be sized, shaped, and/or oriented to promote heat retention and/or efficiency of the sleeping bag. For example, the size, shape, and/or orientation of the sleeping bag insulation chambers may reduce the likelihood of the fill bunching and/or separating and causing cold areas within the sleeping bag. The sleeping bag insulation chambers may be sized, shaped, and/or oriented to promote the heat retention and/or efficiency of the sleeping bag, when coupled to the quilt.

The quilt may have a generally rectangular configuration when laid out flat. The quilt may be used to provide warmth to a user. The quilt may be laid out over the top of a user, may be wrapped around a user, may be laid underneath a user, etc. The quilt may provide warmth and thermal insulation. The quilt may be used in conjunction with a sleeping bag or other bedding to provide additional warmth and thermal insulation to a user. The quilt may provide padding and comfort from the ground.

The shell of the quilt may be the outer layer of fabric that is normally in contact with the open air and ground. The shell could be made with polyester, nylon, cotton, or the like. The fabric of the shell may be oriented to promote heat retention and/or efficiency of the quilt or the sleeping bag.

The liner of the quilt may be the inner fabric that is normally in contact with the sleeping bag when the quilt is coupled to the sleeping bag. The liner may be made with fabric that is soft and comfortable to the touch such as flannel or a synthetic. The inner fabric may promote heat retention and/or efficiency of the sleeping bag and/or quilt.

The quilt may include fill and the fill may be disposed between the shell and the liner. The fill may be natural (e.g., goose down), or man-made (e.g., polyester fiberfill). The fill may promote the heat retention and/or efficiency of the quilt or the sleeping bag.

The quilt may contain one or more seams and the seams may run across all or part of the length of the quilt. The one or more seams may couple the outer shell, the fill, and/or the liner of the quilt. The one or more seams may create one or more compartments or insulation chambers within the quilt.

The quilt insulation chambers may store the fill of the quilt for padding and insulation purposes. The quilt insulation chambers may be separated by seams, fabric, etc. The quilt insulation chambers may run from the head to the foot of the quilt. For example, the quilt insulation chambers may be disposed in a generally vertical direction across all or part of the entire length of the quilt. The quilt insulation chambers may be sized, shaped, and/or oriented to promote heat retention and/or efficiency of the quilt. For example, the size, shape, and/or orientation of the quilt insulation chambers may reduce the likelihood of the fill bunching and/or separating, which may cause cold areas within the quilt. The quilt insulation chambers may be sized, shaped, and/or oriented to interface with the sleeping bag. For example, the quilt insulation chambers may be sized, shaped, and/or oriented to interface with the sleeping bag to promote heat retention and/or efficiency of the sleeping bag when coupled to the sleeping bag.

The user may be a person using or sleeping in the sleeping bag, the quilt, or the sleeping bag assembly.

A detailed description of some exemplary embodiments of the sleeping bag assembly now follows.

FIG. 1A shows an upper perspective view of an embodiment of a sleeping bag assembly 100 with a sleeping bag 110 and a quilt 120. FIG. 1A also shows a user 130 resting inside of the sleeping bag 110. The sleeping bag assembly 100 may include the sleeping bag 110 and the quilt 120.

The sleeping bag 110 may include a body portion 112 and a top flap 114. The body portion 112 may include a top layer and a bottom layer, and the sleeping bag may have a generally tubular shape. The top layer and bottom layer may be coupled on the sides and at the foot of the body portion 112. One or both sides of the body portion 112 may have a zipper running across all or part of the entire length, which may create a way for the user 130 to open the sleeping bag 110 and get in, and then zip the sleeping bag 110 shut. The foot may have the zipper running across all or part of the entire length of the foot, for the purpose of venting at the foot or opening the sleeping bag into a flat rectangle. The sleeping bag may include one or more straps 117, which may be disposed at the foot. The sleeping bag 110 and/or body portion 112 may be rolled and/or folded and secured using the one or more straps 117 to facilitate storage and/or transport.

The body portion 112 may also include sleeping bag insulation chambers 116*a-h* wherein a fill may be stored for padding and insulation purposes. The sleeping bag insulation chambers 116*a-h* may be separated by seams, fabric, etc. As shown in FIG. 1A, the sleeping bag insulation chambers 116*a-h* may run from a first side of the sleeping bag 110 across a width of the sleeping bag 110 to a second side of the sleeping bag 110, in a generally horizontal direction. The sleeping bag insulation chambers 116*a-h* may be sized, shaped, and/or oriented to promote heat retention and/or efficiency of the sleeping bag 110. For example, the size, shape, and/or orientation of the sleeping bag insulation chambers 116*a-h* may reduce the likelihood of the fill bunching and/or separating and causing cold areas within the sleeping bag 110 and promote the heat retention and/or efficiency of the sleeping bag 110.

The top flap 114 may be coupled to the body portion 112 of the sleeping bag 110. The body portion 112 and the top flap 114 may be integrally constructed as part of a unitary, one-piece structure. Alternatively, the body portion 112 and the top flap 114 may be independently constructed as two separate, distinct structures.

The top flap 114 may be coupled to the body portion 112 such that the entire body of the user 130, other than the head of the user 130, is sealed inside of a sleep chamber. The top flap 114 may be permanently sewn to the body portion 112, or may be detachable by employing a zipper(s), button(s), snap(s), clip(s), hook and loop(s) such as Velcro®, or other fastening methods.

The top flap 114 may be coupled to one or more edges or sides of the body portion 112. For example, the top flap 114 may be coupled to the body portion 112 at or near the head edge of a top layer of the body portion 112. The top flap 114 may be coupled to the body portion 112 at shoulder height of the user 130.

The top flap 114 may be coupled to a bottom layer of the body portion 112. The top flap 114 may be coupled to one or more edges or sides of the bottom layer of the body portion 112. For example, the top flap 114 may be coupled to the body portion 112 at or near the head edge of the bottom layer of the body portion 112.

The top flap 114 may include a head opening 119. The top flap 114 may include material and/or padding inside such that the top flap 114 may support the head and/or neck of the user 130. The head opening 119 in the top flap 114 may be large enough for an adult to pass their head through. The head opening 119 in the top flap 114 may come into contact with the neck, head, and/or face of the user 130 and may contain a softer fabric, or liner, sewn on top of, or used in place of the fabric that may be used for other portions of the sleeping bag assembly 100. The head opening 119 of the top flap 114 may comfortably seal around the neck of the user 130.

Figure 1B:
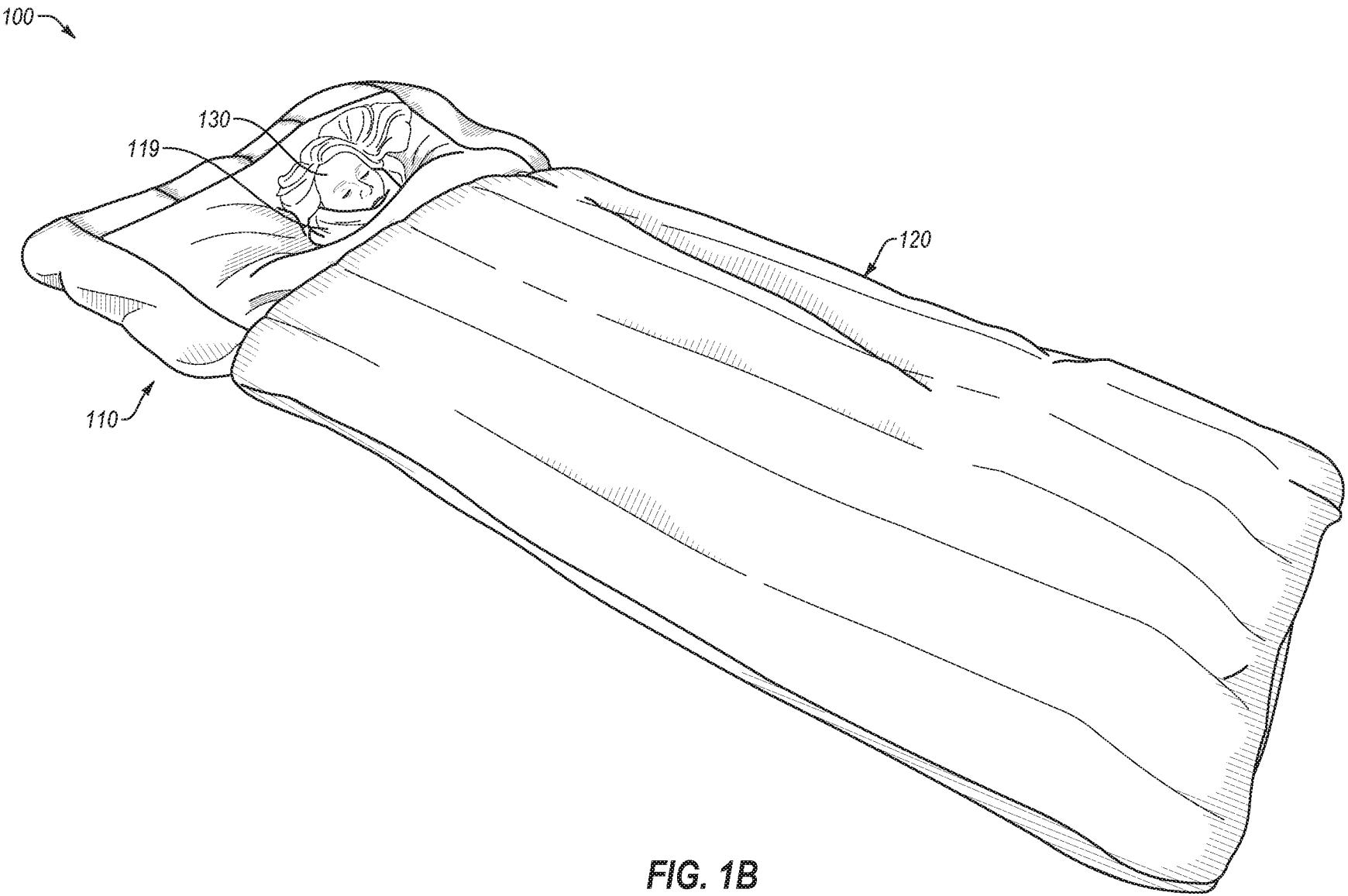
FIG. 1B is an upper perspective view of the sleeping bag assembly with the sleeping bag and the quilt shown in FIG. 1, illustrating the quilt covering the sleeping bag.

FIG. 1B shows the quilt 120 draped over the top of and coupled to the sleeping bag 110. The quilt 120 may include quilt insulation chambers 126*a-f* wherein a fill may be stored for padding and insulation purposes. The quilt insulation chambers 126*a-f* may be separated by seams, fabric, etc. As shown in FIG. 1A, the quilt insulation chambers 126*a-f* may run from the head of the quilt 120 across the length of the quilt 120 to the foot of the quilt, in a generally vertical direction across all or part of the entire length of the quilt 120. The quilt insulation chambers 126*a-f* may be sized, shaped, and/or oriented to promote the heat retention and/or efficiency of the quilt 120. For example, the size, shape, and/or orientation of the quilt insulation chambers 126*a-f* may reduce the likelihood of the fill bunching and/or separating and causing cold areas within the quilt 120 and promote the heat retention and/or efficiency of the quilt 120.

The quilt 120 may be sized and configured such that the quilt 120 may cover a portion of the sleeping bag 110. For example, the quilt 120 may be sized and configured such that the quilt 120 may cover the entire or at least a portion of the body portion 112 of the sleeping bag 110 when the quilt 120 is draped over the top of the sleeping bag 110. The quilt 120, draping over the sleeping bag 110, may form a seal which may help to trap the warmer air inside of the sleep chamber and/or the sleeping bag 110. The quilt 120, draping over the sleeping bag 110, may also cover areas of the sleeping bag 110 that may tend to allow warmer air to escape including, for example, the zipper, seams, areas where the fill may separate or bunch, etc. The quilt insulation chambers 126*a-f* of the quilt 120 may interface with the sleeping bag insulation chambers 116*a-h* such that the areas of the sleeping bag 110 that may tend to allow warmer air to escape are covered and insulated by the quilt 120. Advantageously, this may increase the heat retention and/or efficiency capabilities of the sleeping bag assembly 100.

Figure 2:
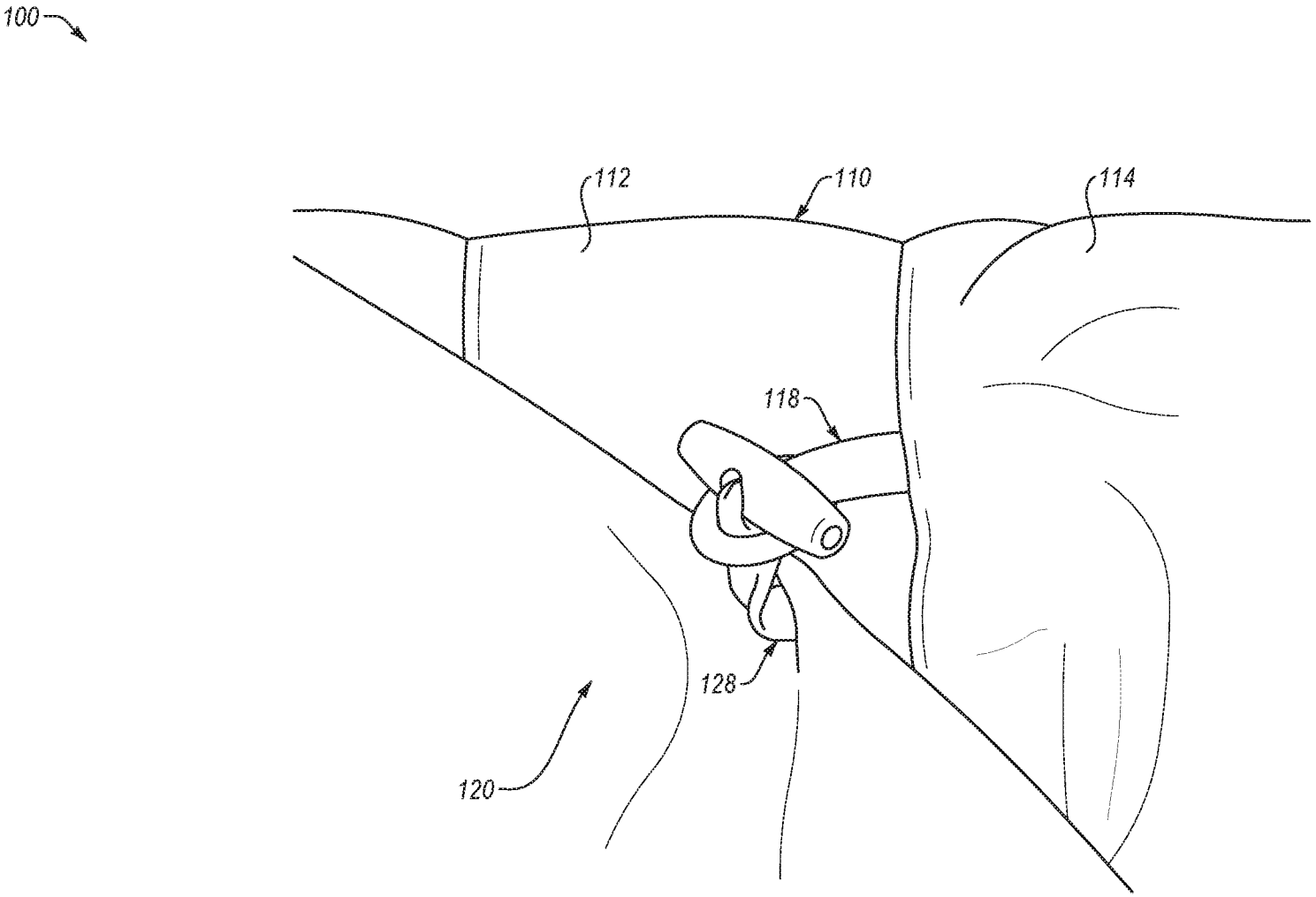
FIG. 2 is a perspective view of an exemplary attachment point of an exemplary embodiments of a sleeping bag assembly with a sleeping bag and a quilt that may allow the sleeping bag and the quilt to be connected.

FIG. 2 shows a perspective view of an embodiment of the sleeping bag assembly 100 wherein the sleeping bag 110 and the quilt 120 are coupled. The sleeping bag 110 may include one or more attachment points 118. The quilt 120 may include one or more attachment points 128. The sleeping bag 110 and the quilt 120 may be coupled via the one or more attachment points 118 and one or more attachment points 128.

The one or more attachment points 118 may be disposed at various locations of the sleeping bag assembly 100, such as the sleeping bag 110. The attachment points 118 may be integrally formed with the sleeping bag 110. The attachment points 118 may be connected to the sleeping bag 110 during the manufacturing process. The attachment points 118 may also be connected to the sleeping bag 110 after the manufacturing process. In an exemplary embodiment, the attachment points 118 may be integratedly formed with the sleeping bag 110 at or near the corners of the sleeping bag 110 or the corners of the body portion 112. The attachment points 118 may be integratedly formed with the sleeping bag 110 near the coupling of the body portion 112 and the top flap 114. The attachment points 118 may include buckles, buttons, clips, hooks, loops, snaps, ties, toggles, etc. For example, as shown in FIG. 2, the one or more attachment points 118 may include a strap with a loop.

The one or more attachment points 128 may be disposed at various locations of the sleeping bag assembly 100, such as the quilt 120. The attachment points 128 may be integrally formed with the quilt 120. The attachment points 128 may be connected to the quilt 120 during the manufacturing process. The attachment points 128 may also be connected to the quilt 120 after the manufacturing process. For example, the one or more attachment points 128 may be integratedly formed with the quilt 120 at or near the corners of the quilt 120. The one or more attachment points 128 may include buckles, buttons, clips, hooks, loops, snaps, ties, toggles, etc. For example, as shown in FIG. 2, the one or more attachment points 128 may include a strap with a toggle.

The one or more attachment points 118 may be configured to be coupled to the one or more attachment points 128. The one or more attachment points 118 may include a female portion that may be configured to be coupled to a corresponding male portion of the one or more attachment points 128. For example, as shown in FIG. 2, the one or more attachment points 118 may include a strap with a loop and the one or more attachment points 128 may include a strap with a toggle configured to be inserted into and secured to the strap with a loop of the one or more attachment points 118.

Figure 3:
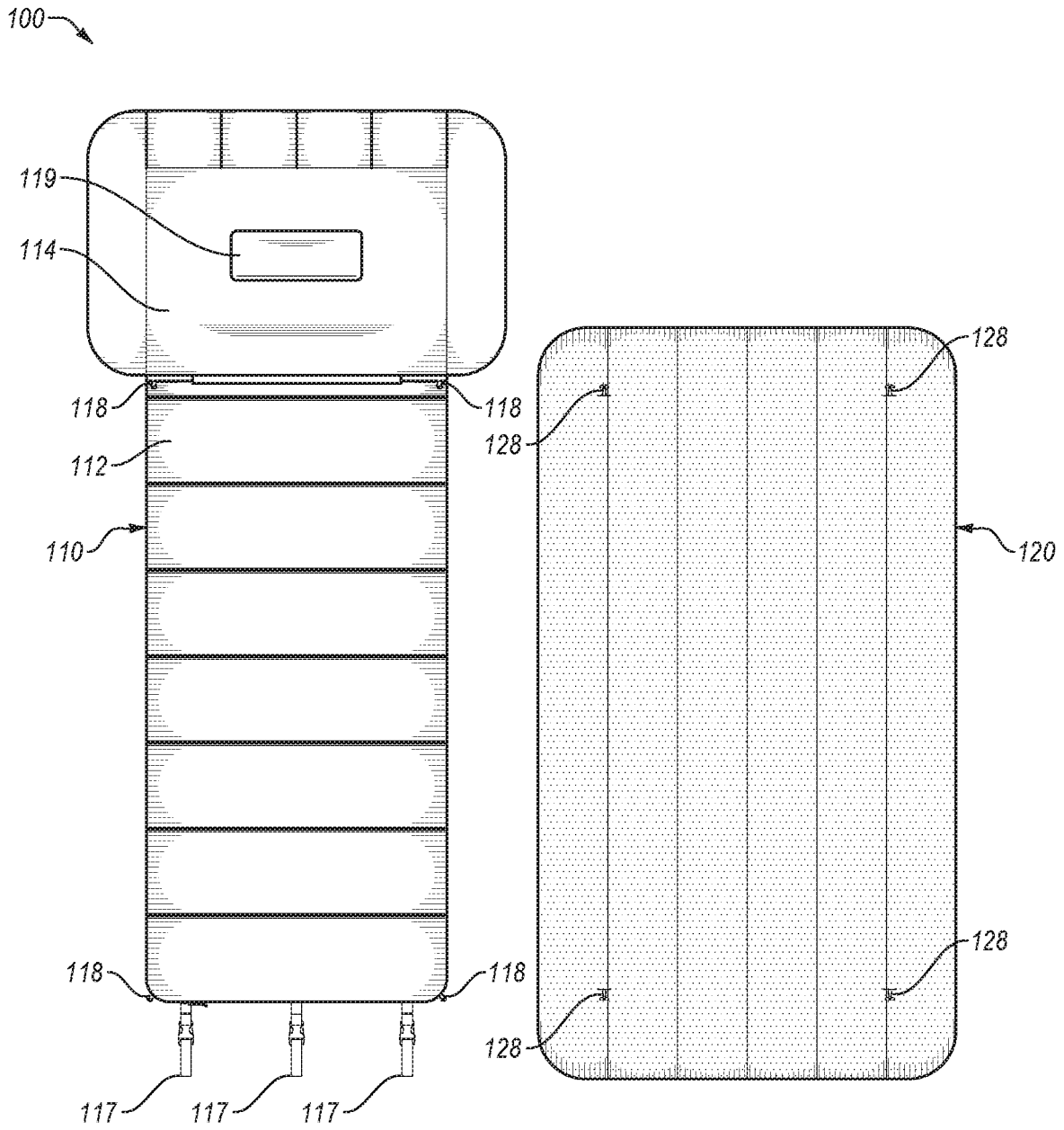
FIG. 3 is a top view of an exemplary embodiment of a sleeping bag assembly with a sleeping bag and a quilt, illustrating the quilt lying next to the sleeping bag with a top surface of the quilt facing down.

FIG. 3 shows a top view of an exemplary embodiment of the sleeping bag assembly 100 with the sleeping bag 110 and the quilt 120, illustrating the quilt 120 lying next to the sleeping bag 110 with a top surface of the quilt 120 in a face-down orientation. The w quilt 120 may include the top surface and a bottom surface. The bottom surface of the quilt 120 may be configured to interface with the top surface of the body portion 112. The bottom surface of the quilt 120 may include one or more attachment points 128. For example, as illustrated in FIG. 3, the one or more attachment points 128 may be disposed near one or more rounded corners of the quilt 120.

A location of the one or more attachment points 128 on the quilt 120 may correspond to a location of the one or more attachment points 118. For example, the one or more attachment points 118 may be disposed in the sleeping bag 110 near one or more corners of the top surface of the body portion 112 and the one or more attachment points 128 may be disposed in the bottom surface of the quilt 120 near the one or more rounded corners of the quilt 120 such that when the quilt 120 is placed on top of the sleeping bag 110 with the bottom surface of the quilt 120 in a face-down orientation, the one or more attachments points 118 may couple to the one or more attachment points 128. The top surface of the quilt 120 may be configured to be in a face-up orientation when the quilt 120 is coupled to the sleeping bag 110.

Figure 4A:
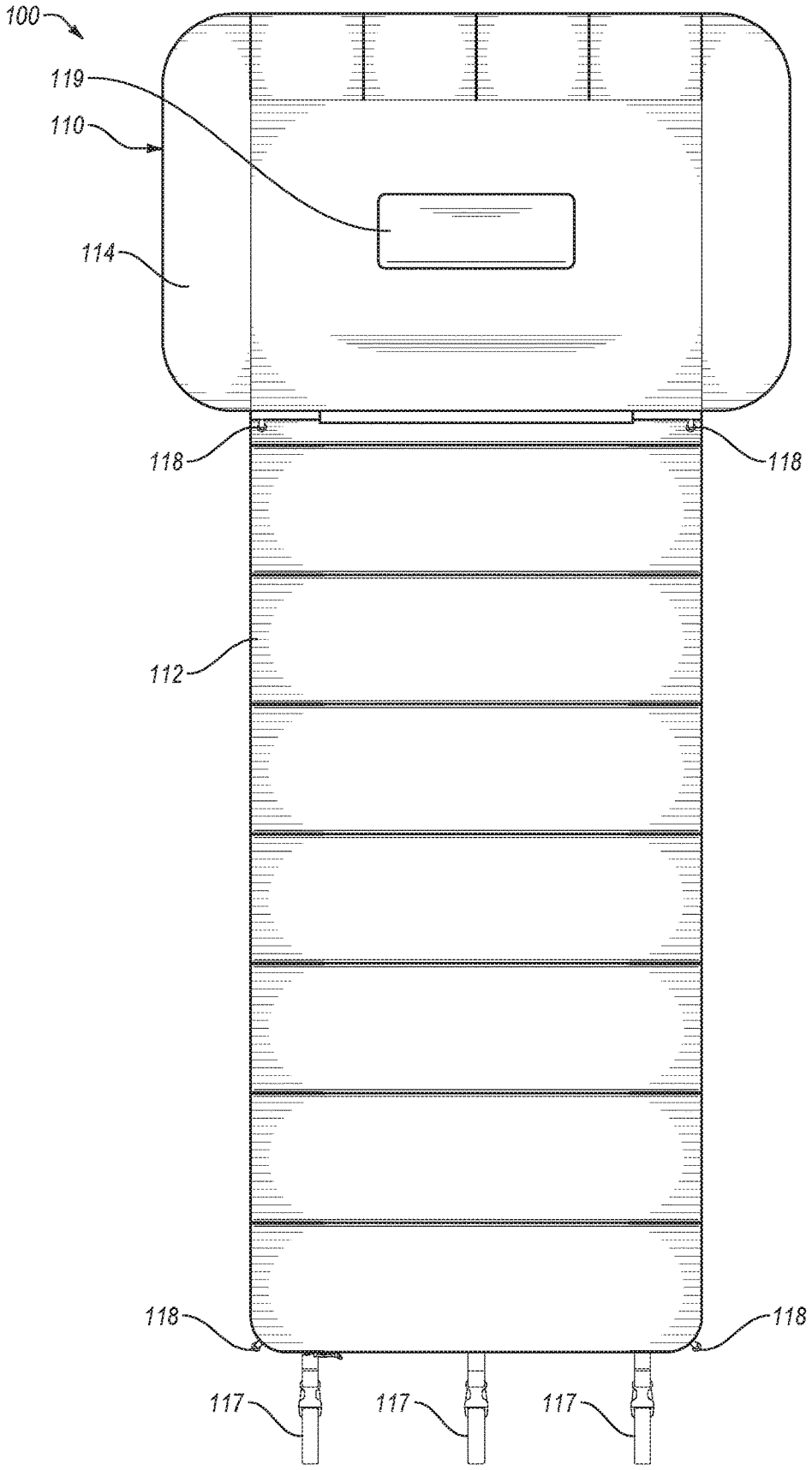
FIG. 4A is a top view of an exemplary embodiment of a sleeping bag assembly with a sleeping bag.

FIG. 4A shows a top view of an embodiment of the sleeping bag assembly 100 with the sleeping bag 110. The sleeping bag 110 may include one or more attachment points 118 integratedly formed with the top surface of the body portion 112 of the sleeping bag 110. For example, the sleeping bag 110 may include one or more attachment points 118 at or near the four corners of the body portion 112 of the sleeping bag 110.

Figure 4B:
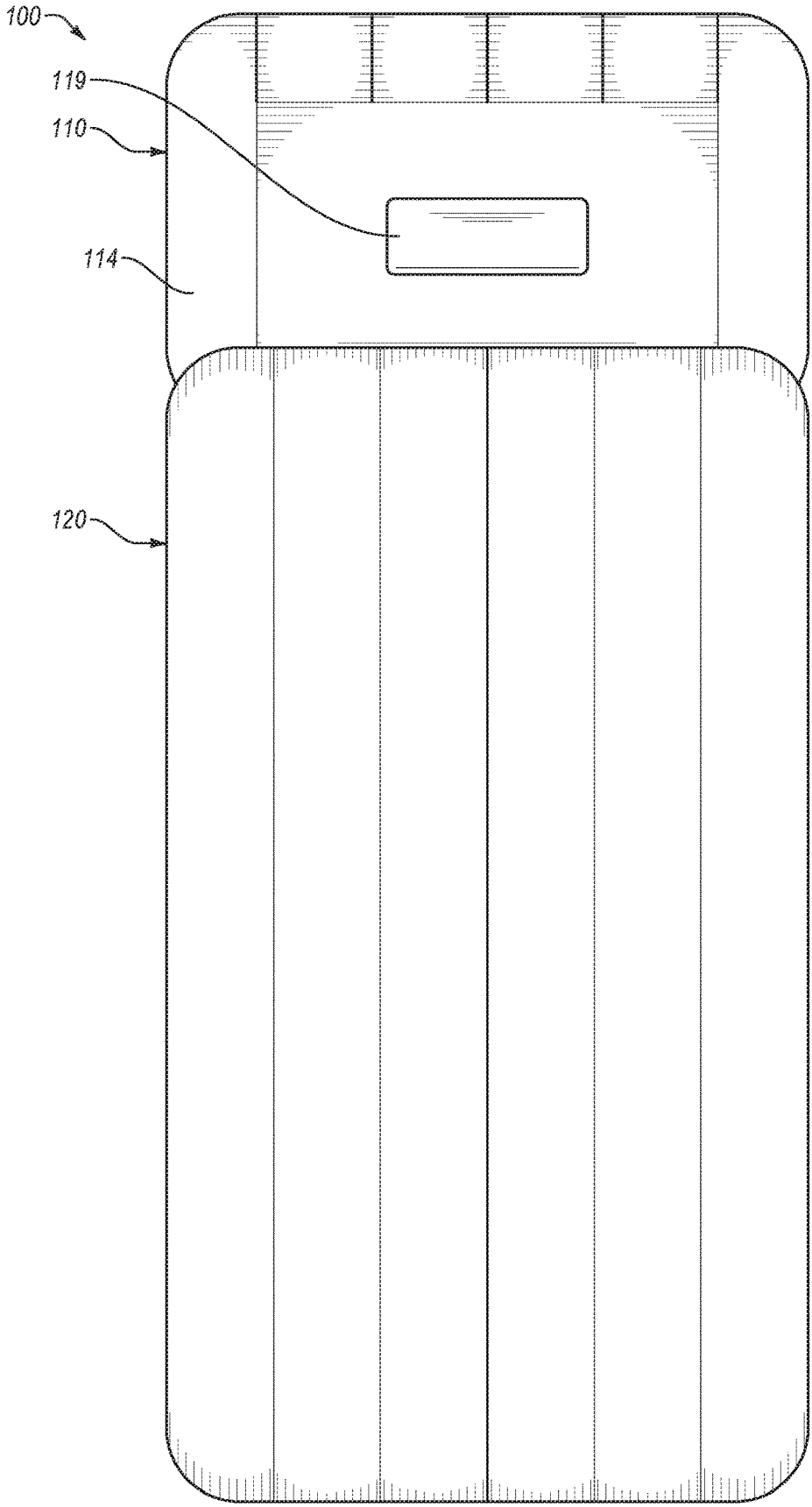
FIG. 4B is a top view of the sleeping bag assembly with the sleeping bag shown in FIG. 4A, illustrating a quilt covering the sleeping bag.

FIG. 4B shows top view of an embodiment of the sleeping bag assembly 100 with the sleeping bag 110 and the quilt 120 draped over the top of and coupled to the sleeping bag 110. The quilt 120 may be draped over the top of and coupled to the sleeping bag 110 such that the entirety of body portion 112 of the sleeping bag 110 is covered by the quilt 120. The quilt 120 may also cover a portion of the top flap 114 of the sleeping bag 110.

Figure 5A:
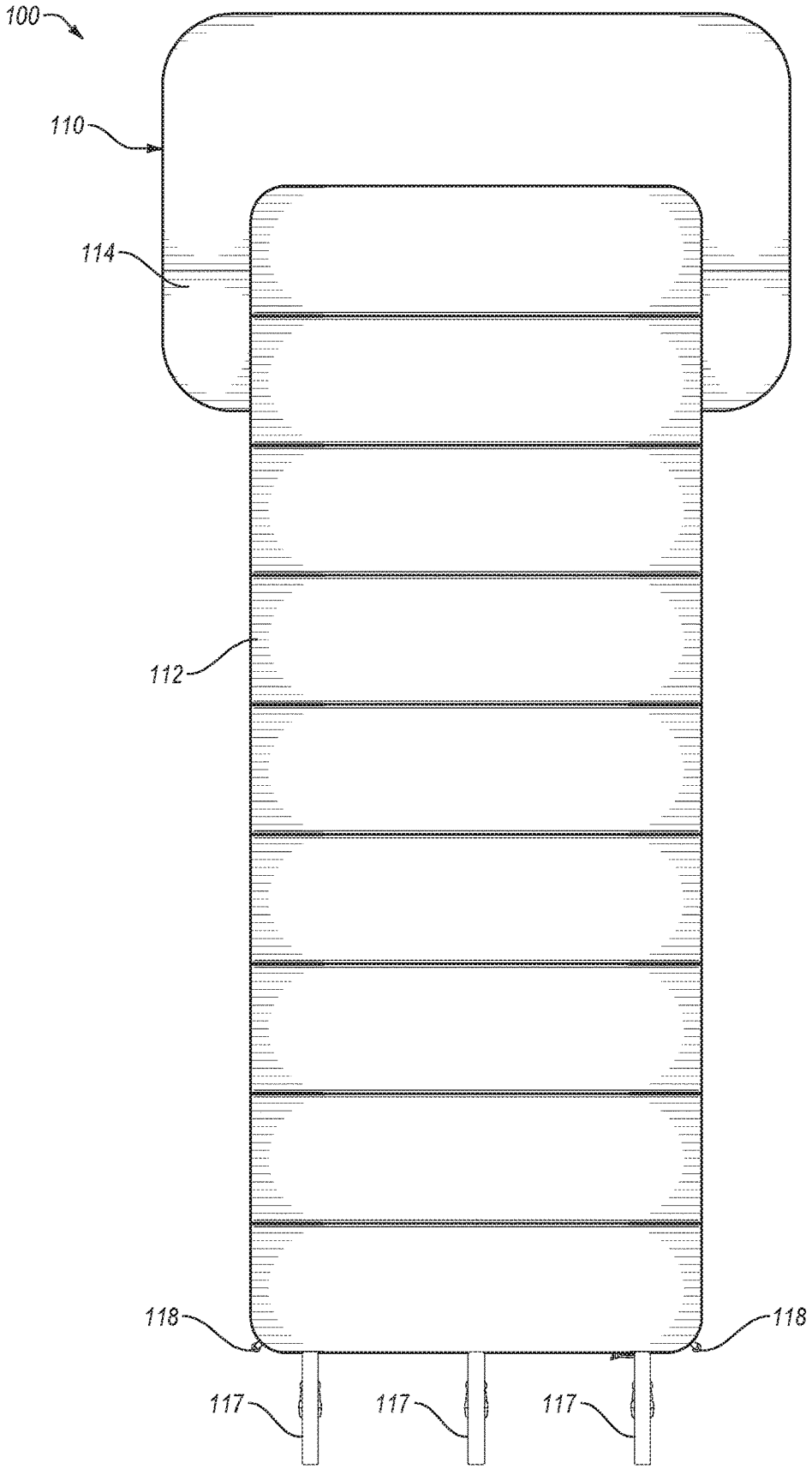
FIG. 5A is a bottom view of an exemplary embodiment of a sleeping bag assembly with a sleeping bag.

FIG. 5A shows a bottom view of an embodiment of the sleeping bag assembly 100 with the sleeping bag 110.

Figure 5B:
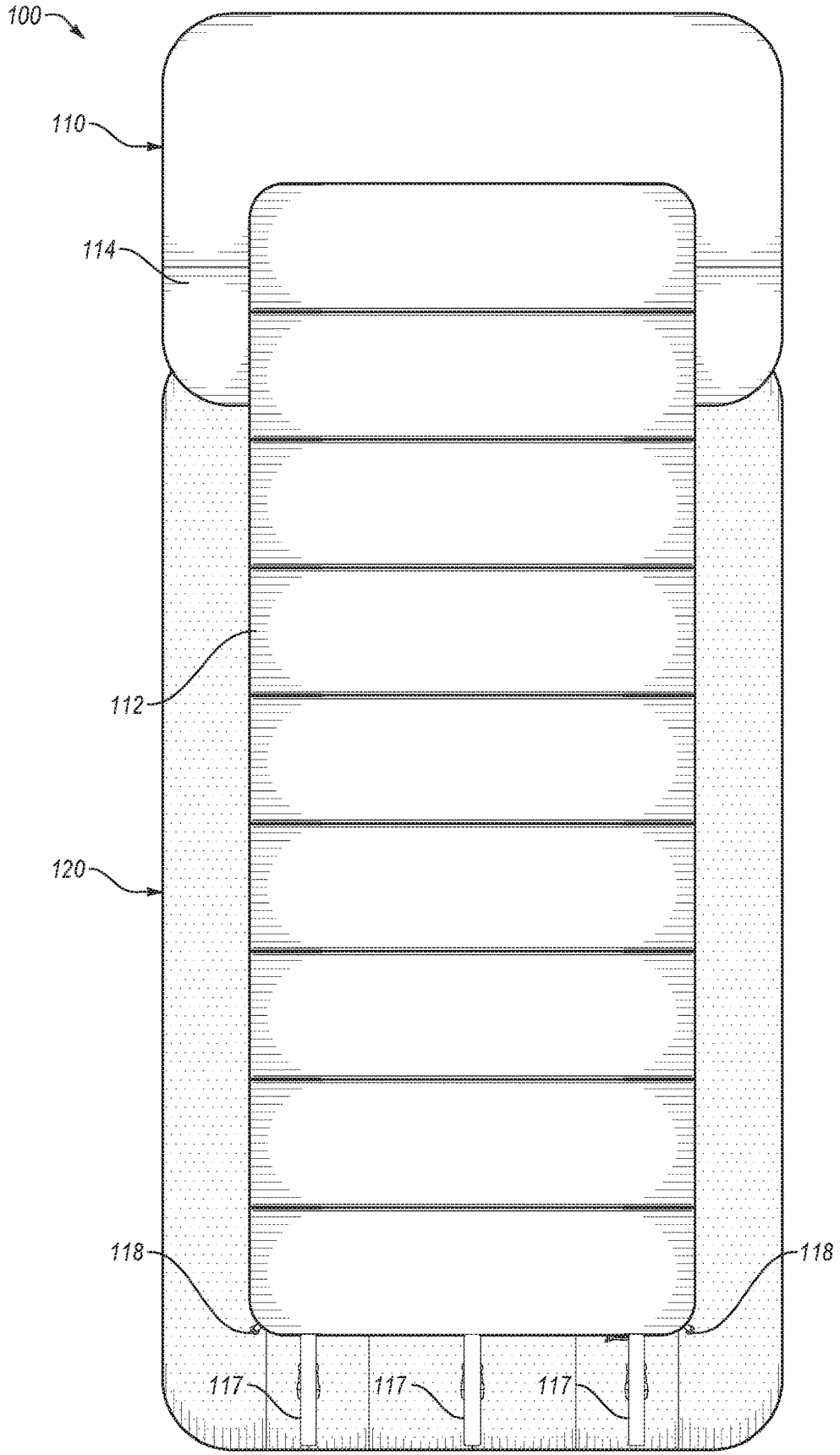
FIG. 5B is a bottom view of the sleeping bag assembly with the sleeping bag shown in FIG. 5A, illustrating a quilt covering the sleeping bag.

FIG. 5B shows a bottom view of an embodiment of the sleeping bag assembly 100 with the sleeping bag 110 and the quilt 120 draped over the top of and coupled to the sleeping bag 110.

Figure 6A:
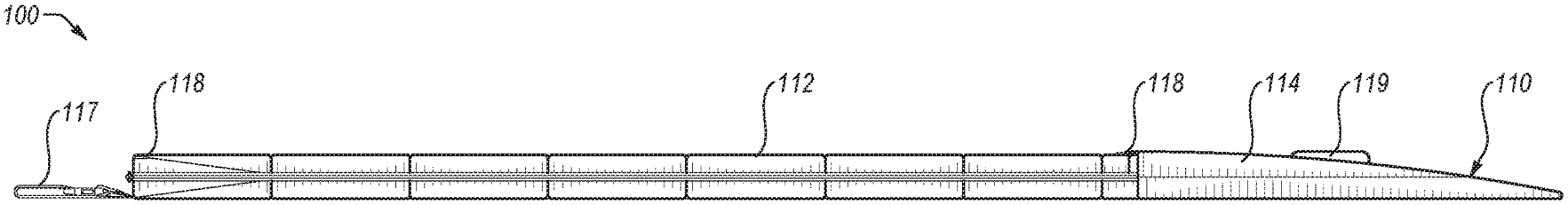
FIG. 6A is a side view of an exemplary embodiment of a sleeping bag assembly with a sleeping bag.

FIG. 6A shows a side view of an embodiment of the sleeping bag assembly 100 with the sleeping bag 110.

Figure 6B:
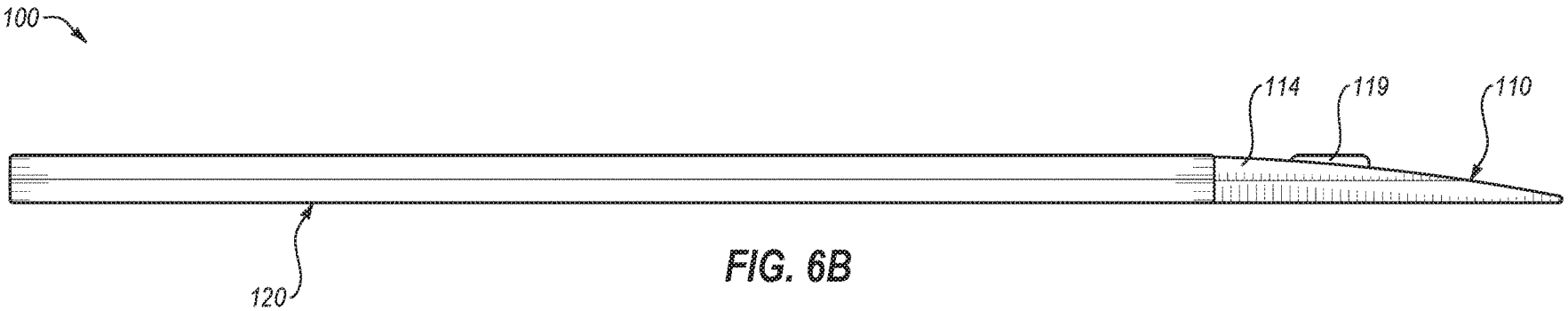
FIG. 6B is a side view of the sleeping bag assembly with the sleeping bag shown in FIG. 6A, illustrating a quilt covering the sleeping bag.

FIG. 6B shows a side view of an embodiment of the sleeping bag assembly 100 with the sleeping bag 110 and the quilt 120 draped over the top of and coupled to the sleeping bag 110. The quilt 120 may be draped over the top of and coupled to the sleeping bag 110 such that the hems, zippers, and/or seams that may be present within the sleeping bag 110 are covered by the quilt 120.

Figure 7A:
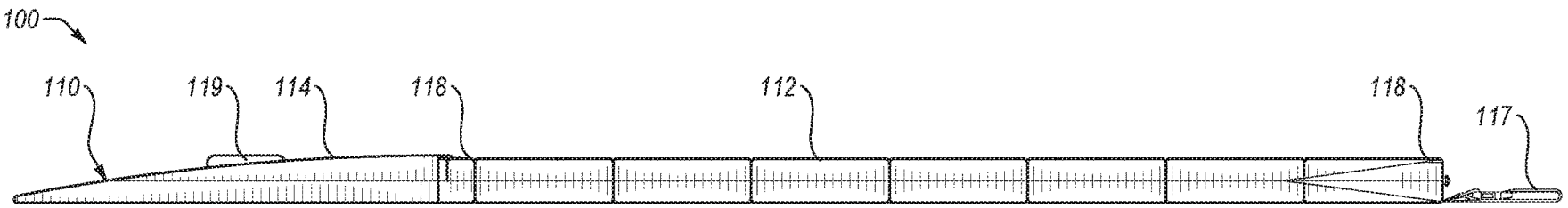
FIG. 7A is a side view of an exemplary embodiment of a sleeping bag assembly with a sleeping bag.

FIG. 7A shows a side view of an embodiment of the sleeping bag assembly 100 with the sleeping bag 110.

Figure 7B:
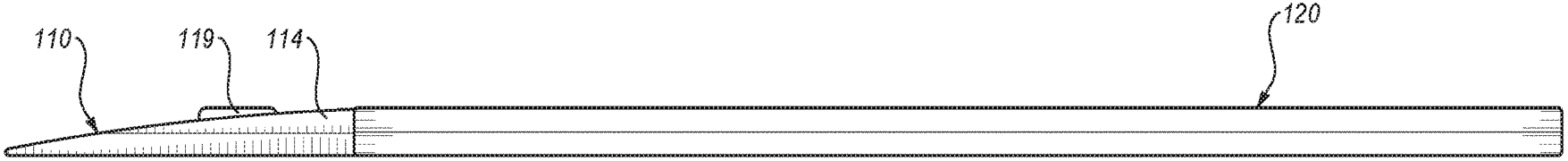
FIG. 7B is a side view of the sleeping bag assembly with the sleeping bag shown in FIG. 7A, illustrating a quilt covering the sleeping bag.

FIG. 7B shows a side view of an embodiment of the sleeping bag assembly 100 with the sleeping bag 110 and the quilt 120 draped over the top of and coupled to the sleeping bag 110.

Figure 8A:
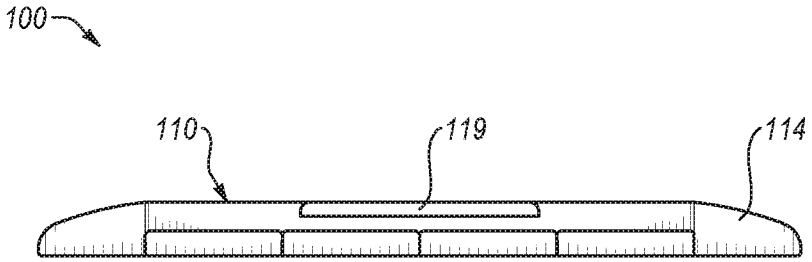
FIG. 8A is a front view of an exemplary embodiment of a sleeping bag assembly with a sleeping bag.

FIG. 8A shows a front view of an embodiment of the sleeping bag assembly 100 with the sleeping bag 110.

Figure 8B:
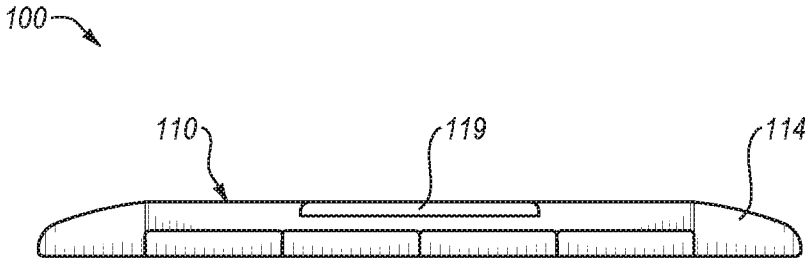
FIG. 8B is a front view of the sleeping bag assembly with the sleeping bag shown in FIG. 8A, illustrating a quilt covering the sleeping bag.

FIG. 8B shows a front view of an embodiment of the sleeping bag assembly 100 with the sleeping bag 110 and the quilt (not shown) draped over the top of and coupled to the sleeping bag 110.

Figure 9A:
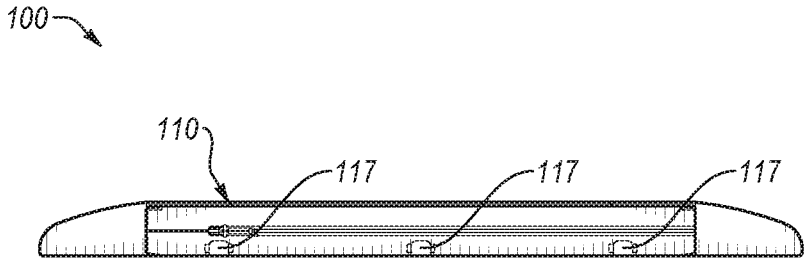
FIG. 9A is a rear view of an exemplary embodiment of a sleeping bag assembly with a sleeping bag.

FIG. 9A shows a rear view of an embodiment of the sleeping bag assembly 100 with the sleeping bag 110.

Figure 9B:
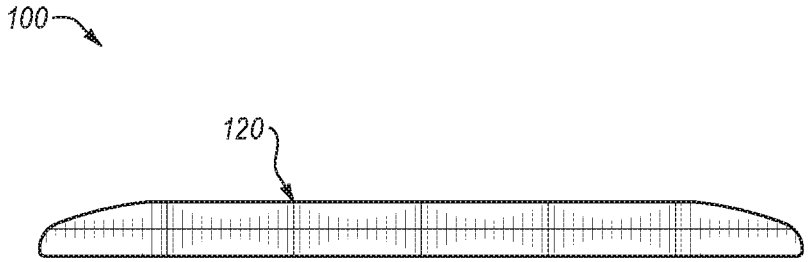
FIG. 9B is a rear view of the sleeping bag assembly with the sleeping bag shown in FIG. 9A, illustrating a quilt covering the sleeping bag.

FIG. 9B shows a rear view of an embodiment of the sleeping bag assembly 100 with the sleeping bag 110 and the quilt 120 draped over the top of and coupled to the sleeping bag 110.

What is claimed is:

1. A sleeping bag assembly comprising:

a sleeping bag including a top layer and a bottom layer, the top layer and the bottom layer forming at least a portion of a body of the sleeping bag;

one or more sleeping bag connecting portions connected to the sleeping bag, a first sleeping bag connecting portion connected to a first portion of the sleeping bag and a second sleeping bag connecting portion connected to a second portion of the sleeping bag;

a quilt sized and configured to be coupled to the sleeping bag, a lower portion of the quilt disposed on an upper portion of the top layer when the quilt is coupled to the sleeping bag, the quilt including a body portion sized and configured to cover at least a portion of the sleeping bag and one or more outer borders sized and configured to extend beyond one or more edges of the sleeping bag when the quilt is connected to the sleeping bag; and one or more quilt attachment points sized and configured to be attached to the sleeping bag connecting portions to couple the quilt and the sleeping bag, the quilt attachment points spaced inwardly and spaced apart from an outer edge of the quilt to allow the one or more outer borders of the quilt to drape over and seal one or more edges of the sleeping bag, the quilt attachment points spaced apart from other fastening mechanisms, the one or more quilt attachment points comprising:

a first quilt attachment point spaced apart from a first outer border of the quilt, the first quilt attachment point sized and configured to be connected to the first sleeping bag connecting portion, the first outer border of the quilt extending beyond a first outer portion of the sleeping bag, the first outer border of the quilt sized and configured to drape over and seal the first outer portion of the sleeping bag, the first outer border of the quilt sized and configured to contact a surface supporting the sleeping bag while the sleeping bag is in use; and a second quilt attachment point spaced apart from a second outer border of the quilt, the second quilt attachment point sized and configured to be connected to the second sleeping bag connecting portion, the second outer border of the quilt extending beyond a second outer portion of the sleeping bag, the second outer border of the quilt sized and configured to drape over and seal the second outer portion of the sleeping bag, the second outer border of the quilt sized and configured to contact the surface supporting the sleeping bag while the sleeping bag is in use.

2. The sleeping bag assembly as in claim 1, wherein the one or more sleeping bag connecting portions are integrally formed with the sleeping bag.

3. The sleeping bag assembly as in claim 1, wherein the one or more quilt attachment points are integrally formed with the quilt.

4. The sleeping bag assembly as in claim 1, wherein the one or more sleeping bag connecting portions are integrally formed with the sleeping bag and the one or more quilt attachment points are integrally formed with the quilt, the one or more connecting portions of the sleeping bag coupled to the one or more attachment points of the quilt when the quilt is coupled to the sleeping bag.

5. The sleeping bag assembly as in claim 1, wherein the one or more sleeping bag connecting portions are integrally formed with a body portion of the sleeping bag at a first corner of the body portion, at a second corner of the body portion, at a third corner of the body portion, and at a fourth corner of the body portion; and wherein the one or more quilt attachment points are integrally formed with the quilt, the first quilt attachment point spaced apart from a first corner of the quilt, the second quilt attachment point spaced apart from a second corner of the quilt, a third quilt attachment point spaced apart from a third corner of the quilt, and a fourth quilt attachment point spaced apart from a fourth corner of the quilt, the one or more connecting portions of the sleeping bag coupled to the one or more attachment points of the quilt when the quilt is coupled to the sleeping bag.

6. The sleeping bag assembly as in claim 1, wherein when the quilt is coupled to the sleeping bag, the quilt is sized and configured to drape over and extend past three or more edges of the sleeping bag and contact the surface supporting the sleeping bag while the sleeping bag is in use.

7. The sleeping bag assembly as in claim 1, wherein when the quilt is coupled to the sleeping bag, the quilt is sized and configured to drape over and extend past two or more edges of the sleeping bag, the two or more edges of the sleeping bag including a fastener mechanism connecting the top layer and the bottom layer of the sleeping bag, the quilt covering the fastener mechanism connecting the top layer and the bottom layer of the sleeping bag and contacting the surface supporting the sleeping bag while the sleeping bag is in use to form a seal about the fastener mechanism connecting the top layer and the bottom layer of the sleeping bag.

8. The sleeping bag assembly as in claim 1, wherein when the quilt is coupled to the sleeping bag, the quilt is sized and configured to extend past a top portion, a left side, a right side, and a bottom portion of the sleeping bag.

9. The sleeping bag assembly as in claim 1, wherein when the quilt is coupled to the sleeping bag, the quilt is sized and configured to cover one or more seams of the sleeping bag.

10. The sleeping bag assembly as in claim 1, wherein when the quilt is coupled to the sleeping bag, the quilt is sized and configured to cover one or more zippers of the sleeping bag.

11. The sleeping bag assembly as in claim 1, wherein when the quilt is coupled to the sleeping bag, the quilt is sized and configured to form a seal about two or more portions of the sleeping bag by contacting the surface supporting the sleeping bag.

12. The sleeping bag assembly as in claim 1, wherein the sleeping bag further comprises a body portion, the quilt draping over the body portion and configured to form a seal about the body portion while the sleeping bag is in use; and a top flap coupled to the body portion, the quilt draping over a portion of the top flap.

13. The sleeping bag assembly as in claim 1, wherein the sleeping bag further comprises one or more sleeping bag insulation chambers extending from a first side of the sleeping bag across a width of the sleeping bag to a second side of the sleeping bag; and wherein the quilt includes one or more quilt insulation chambers, the one or more quilt insulation chambers extending from a head of the quilt across a length of the quilt to a foot of the quilt.

14. The sleeping bag assembly as in claim 1, wherein the quilt includes one or more quilt insulation chambers, the one or more quilt insulation chambers extending from a head of the quilt across a length of the quilt to a foot of the quilt.

15. The sleeping bag assembly as in claim 1, where one or more quilt insulation chambers are configured to interface with one or more sleeping bag insulation chambers to promote heat retention and efficiency of the sleeping bag.

16. The sleeping bag assembly as in claim 1, wherein the sleeping bag further includes one or more sleeping bag insulation chambers extending in a first direction;

wherein the quilt further includes one or more quilt insulation chambers extending in a second direction; and wherein the first direction is different and at an angle to the second direction.

17. A quilt comprising one or more quilt connecting portions configured to couple the quilt to a sleeping bag, the sleeping bag including a top layer and a bottom layer, the sleeping bag having a generally tubular shape, the quilt including a lower portion that is sized and configured to be disposed on an upper portion of the top layer of the sleeping bag when the quilt is coupled to the sleeping bag, the quilt including a body portion sized and configured to cover at least a portion of the sleeping bag and one or more outer borders sized and configured to extend beyond one or more edges of the sleeping bag when the quilt is connected to the sleeping bag, the one or more outer borders of the quilt extending beyond the one or more edges of the sleeping bag and contacting a surface supporting the sleeping bag during use of the sleeping bag, a first quilt connecting portion spaced apart from a first outer border of the quilt and spaced apart from other fastening mechanisms, the first quilt connecting portion sized and configured to be connected to a first sleeping bag connecting portion and allow the first outer border of the quilt to drape over and seal a first outer portion of the sleeping bag by contacting the surface supporting the sleeping bag during use of the sleeping bag, a second quilt connecting portion spaced apart from a second outer border of the quilt and spaced apart from other fastening mechanisms, the second quilt connecting portion sized and configured to be connected to a second sleeping bag connecting portion and allow the second outer border of the quilt to drape over and seal a second outer portion of the sleeping bag by contacting the surface supporting the sleeping bag during use of the sleeping bag.

18. The quilt as in claim 17, wherein when the quilt is sized and configured to form a seal about a zipper, seam, or less insulated portion of the sleeping bag.

19. The quilt as in claim 18, wherein the quilt includes one or more quilt insulation chambers, the one or more quilt insulation chambers extending from a head of the quilt across a length of the quilt to a foot of the quilt.

20. The quilt as in claim 19, wherein the quilt insulation chambers are configured to interface with the sleeping bag to promote heat retention and efficiency of the sleeping bag.

* * * * *